United States Patent [19]

Rood

[11] 4,319,743

[45] Mar. 16, 1982

[54] TWO-DIRECTION ROTARY PAPER ALIGNER

[75] Inventor: Allan J. Rood, Longmont, Colo.

[73] Assignee: International Business Machines Corp., Armonk, N.Y.

[21] Appl. No.: 120,444

[22] Filed: Feb. 11, 1980

[51] Int. Cl.[3] ..... B65H 29/22; B65H 9/10; B65H 29/32; B65H 31/34

[52] U.S. Cl. ..... 271/184; 271/194; 271/236; 271/287; 271/314; 414/36

[58] Field of Search ..... 271/314, 306, 207, 221, 271/222, 220, 184, 185, 177, 178, 236, 237, 250, 251, 252, 278, 287, 194, 196, 84, 238; 414/36, 35

[56] References Cited

U.S. PATENT DOCUMENTS

| | | | |
|---|---|---|---|
| 1,826,624 | 10/1931 | Mason . | |
| 2,167,823 | 8/1939 | Backhouse | 271/250 |
| 2,256,823 | 9/1941 | Battey et al. | 271/250 |
| 2,910,293 | 10/1959 | Kelchner . | |
| 3,083,014 | 3/1963 | Howdle et al. | 271/221 |
| 3,544,098 | 12/1970 | Hawley et al. | 271/236 |
| 3,593,992 | 7/1971 | Hanson | 271/221 |
| 3,847,388 | 11/1974 | Lynch | 271/220 |
| 3,910,568 | 10/1975 | Brown et al. | 271/287 X |
| 3,970,299 | 7/1976 | Berger et al. | 271/250 |
| 4,047,713 | 9/1977 | Snellman et al. | 271/221 |
| 4,102,284 | 7/1978 | Rohr | 271/84 X |

FOREIGN PATENT DOCUMENTS

| | | |
|---|---|---|
| 528368 | 6/1931 | Fed. Rep. of Germany . |
| 376554 | 7/1932 | United Kingdom . |
| 1550078 | 8/1979 | United Kingdom . |

OTHER PUBLICATIONS

Skeels, T. "Sheet Stacker", *Xerox Disclosure Journal,* vol. 4, No. 1, Jan./Feb. 1979, p. 67.

*Primary Examiner*—Bruce H. Stoner, Jr.
*Attorney, Agent, or Firm*—Joscelyn G. Cockburn

[57] ABSTRACT

A device for aligning sheets in a stack relative to at least one reference surface of a support tray. The device includes at least one movable alignment arm extending into the tray and a mechanism for transporting the arm to contact a sheet periodically and to move said sheet in a direction perpendicular to the reference surface for alignment.

16 Claims, 7 Drawing Figures

TWO-DIRECTION ROTARY PAPER ALIGNER

BACKGROUND OF THE INVENTION

1. Field of the Invention

The invention relates to devices for aligning articles, and in particular, devices for aligning sheets or the like into edge-aligned stacks.

2. Prior Art

In handling planar articles such as paper sheets outputted from printers, presses, and electrophotographic copiers or the like, it is often required to stack the sheets into aligned stacks for operations such as cutting, stapling and binding. The process of forming stacks of aligned sheets may be done by mechanical means or nonmechanical means.

When sheets are properly aligned with one another by means of the human hands, the process is often referred to as nonmechanical. The partially-aligned stack of sheets is held by the hand, and by tapping adjacent edges of the sheet alternately against a flat surface, forces the sheets into alignment. Although this procedure works satisfactorily, it is not well suited for commercial adaptation. Moreover, the procedure is time-consuming and expensive.

In an attempt to circumvent some of the disadvantages associated with human hands, mechanical devices have been used to align sheets. One type of prior art mechanical aligners consists of an inclined table with a pair of jogger arms pivotally mounted to the table. The jogger arms have a pair of paddle portions extending upwardly above the level of the table along two adjacent sides. The table is inclined towards the paddle portions of the jogger arm. As such, a gravitational force is imparted to the sheets along the direction of the incline. The force helps to bring the sheets into alignment. A driving means consisting of a motor-driven camming system activates the jogger arms which causes pivotal movement of the paddles. The paddles tamp against the sides or edges of the sheets delivered on the table to form a properly aligned stack. A more detailed description of the above prior art joggers as a mechanical aligner is given in U.S. Pat. No. 3,593,992.

Another type of prior art aligners is described in U.S. Pat. No. 3,083,014. In that patent, sheet-like articles to be formed into edge-aligned stacks are delivered to a stacker and jogger mechanism in an overlapped orientation. The stacker and jogger mechanism consists of an alignment surface and a movable table for supporting the articles. Two pair of resilient bladed rotating paddle wheels are mounted; one pair on each side of the table. The paddle wheels in each pair are in spaced relation on its respective side of the table. The paddles are inclined with respect to the table. As sheet-like articles are delivered to the table in the direction of paddle rotation, the rotating resilient paddle wheels contact and lightly impact the opposite edges of the sheets to impart a jogging or vibratory action which aligns the sheet-like articles against the alignment surface.

Although the above-described aligners probably work satisfactory for their intended purpose, there are times when the above aligners do not align the sheets with sufficient accuracy. For example, if some of the sheets in a particular size classification (such as $8\frac{1}{2}'' \times 14''$ etc.) are slightly undersize, that is, less than the stated size for that classification, the prior art aligners are unable to form a well-aligned stack. The inability of the aligners to accurately align sheets in a stack wherein the dimension of some sheets are slightly less than the stated dimension stems from the fact that the prior art aligners all work on the edges of the sheets. The smaller sheets in a mixed size stack do not extend to the edges of the stack, therefore, tamping on the side of the stack does not always align the sheets since there is no contact between the tamping element and the smaller size sheets.

Also, due to the configuration of the abovereferenced systems, sheets are positively referenced in one direction only. The sheets are driven up to a reference edge perpendicular to the direction of travel. Aligning the sheets in a lateral direction (not the direction of travel) depends on the uniformity and condition of the abovementioned paddles.

SUMMARY OF THE INVENTION

It is, therefore, the main object of the present invention to align paper sheets more accurately than was heretofore possible.

The paper sheet aligner includes a stack support tray having at least one reference or alignment surface. A trajectory-generating apparatus having a central opening and a cam surface fabricated about the central opening, is positioned relative to the support tray. A rotary shaft having a cam follower thereon is mounted in the central opening. The shaft extends in a plane perpendicular to the plane of the tray. An alignment member is mounted to the shaft in spaced relation to the cam follower. As the shaft is driven about its axis of rotation with the cam follower following the cam surface, the alignment member is adjusted (i.e. raised) a predetermined height above the bottom of the tray. The alignment member is next brought into contact with the topmost sheet in the tray. The alignment member pulls the sheet along two substantially perpendicular directions to align said sheet with the alignment surface.

In one feature of the invention, a plurality of alignment members are mounted to a common rotating shaft with a single cam follower following a common cam surface. The shaft is positioned relative to a plurality of support trays. The configuration is such that one alignment member is dedicated to align sheets in only one associated tray.

In another feature of the invention, a single alignment member and an associated camming means sequentially align sheets in a plurality of support trays. A positioning means indexes the alignment member and its associated camming means from one support tray to another.

The foregoing and other features and advantages of the invention will be apparent from the following more particular description of the preferred embodiment of the invention, as illustrated in the accompanying drawings.

DESCRIPTION OF THE PREFERRED EMBODIMENT

The invention to be described hereinafter finds use in any environment where sheet-like material, such as paper sheet, is to be aligned in a vertical pile in a container or paper support means. The paper container preferably has one or more reference surfaces or edges against which the sheet-like material is to be aligned. Since the paper aligner invention works well with an electrophotographic copying machine wherein copy sheets outputted from the machine are to be aligned, for purposes of description it will be assumed that the invention is adopted for such a use. To this end, it should be clearly understood at the onset, that this should not be regarded as a limitation on the scope of the present invention. The showing is merely for purposes of explanation, and it is well within the scope of one skilled in the art to use the invention in any environment where paper is to be arranged in edgewise alignment.

Figure 1:
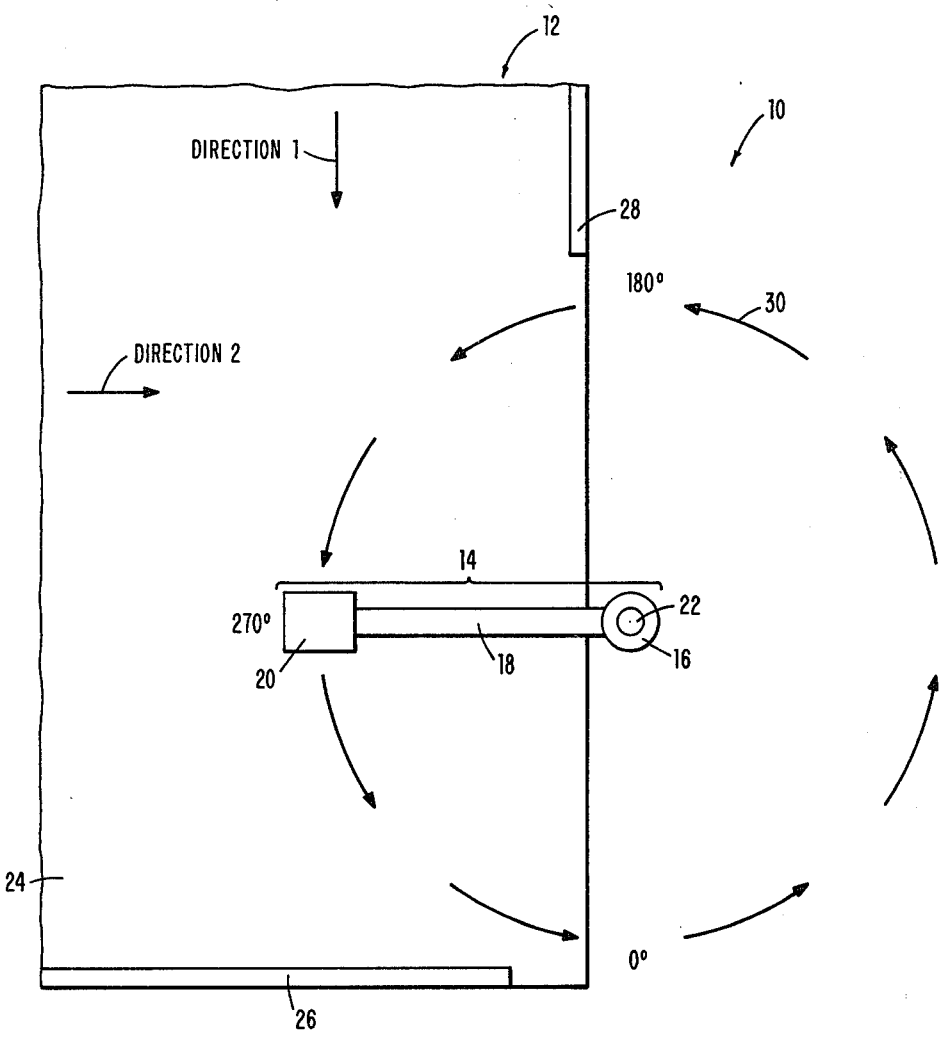
FIG. 1 is a conceptual showing of a two-directional rotary paper aligner according to the teaching of the present invention.

FIG. 1 is a schematic showing the top view of the paper aligner according to the present invention. The showing in FIG. 1 is a conceptual representation according to the teaching of the present invention. This showing is helpful in understanding the invention. The paper aligner 10 includes a sheet support tray 12 and a single-ended aligner 14. The aligner 14 includes a coupling member 16, an elongated arm 18 and a pad 20. The elements of the aligner (that is, the coupler, elongated arm and pad) are integrally connected into a unified structure. The coupler is mounted to a support member 22. The support member is preferably a shaft. The pad 20 is fabricated from a material having a high coefficient of friction.

In the preferred embodiment of the present invention, the pad is fabricated from urethane rubber. The support tray 12 includes a bottom 24 and alignment or reference surfaces 26 and 28, respectively. The reference surfaces extend upwardly from the bottom of the support tray. The support member 22 and its attachment are mounted relative to the support tray. As paper sheets are hurled into the tray along direction 1 or direction 2 from an electrophotographic convenience copier or the like (not shown), the aligner is transported through a trajectory or path of travel 30 so that the aligner periodically enters the support tray and pulls the hurled sheet in a first direction parallel to direction 1 to align the sheet against reference edge 26 and then pulls the sheet in a second direction parallel to direction 2, to align the sheet against reference edge 28. As such, the sheet (not shown) is pulled along two substantially mutual perpendicular directions for alignment against the reference edges. One or both of the reference edges may be a gated assembly. As such, the gated assembly can be lowered and the stacked sheets (not shown) can be extracted from the tray by a mechanical arm or the like.

Still referring to the schematic in FIG. 1, the aligner 14 may be cycled through 360 degrees (360°) or any desired multiple thereof, following the insertion of each sheet into the support tray or bin 12. Since sheets are hurled into the bin intermittently, as a stack builds into the bin, it becomes necessary for the aligner to adjust in height so that it can contact the uppermost or topmost sheet aligning the same with the stack already in the tray. By way of example, assume that the aligner begins at a zero degree (0°) angle in its path of travel. As the aligner is rotated in a direction shown by the arrows, it is adjusted or elevated in a plane perpendicular to the plane of the paper. This elevation is of a height suitable to clear the maximum height of sheets to be stacked in the tray. At approximately 180° in the path of travel, the aligner will level off at this height and enter the bin. At approximately 270° the aligner will lower from its elevated position, and the pad will drop to the bottom of the bin or onto the topmost sheet of the just fed sheet of paper. The pad will now pull the paper in a direction parallel to direction 1 until the corner of the sheet is squared to reference edge 26. The pad next pulls on the paper in a direction parallel with direction 2 until the corner of the paper is square with reference edge 28. The pad then slides on the paper until it exits the bin at about 0°. This completes the end of the cycle. The cycle is then repeated, for each sheet inserted into the bin, until a stack of sheets is formed into the bin.

Figure 2:
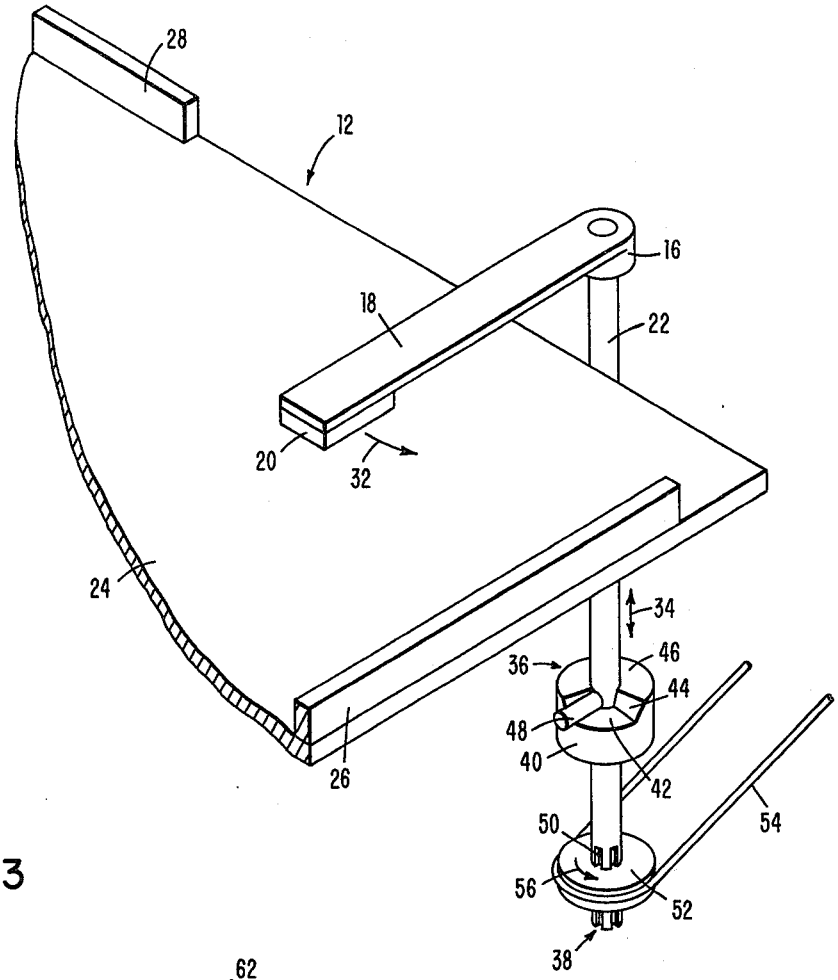
FIG. 2 shows an isometric view of the aligner aligning sheets in a single sheet support tray.

FIG. 2 now shows a pictorial view of a paper aligner according to the teaching of the present invention. In this figure, elements which are common to previously-identified elements, will be identified by the same numeral. In describing FIG. 2, conventional elements such as a support frame for bin 12 and a support means for the aligner mechanism will not be discussed. Support elements are usually conventional and can be fabricated by people having ordinary skill in the art. The paper support tray has reference edges 26 and 28, respectively. Paper sheets entering the bin are pulled by the aligner until their edges are squared against the reference surfaces. The aligner includes an elongated arm 18 integrally connected to a coupler 16. The coupler 16 is fixedly mounted to shaft 22. A friction pad 20 is attached to the free end of elongated arm 18. The configuration is such that as shaft 22 rotates the aligner through a predetermined orbit, it is cyclically positioned so that pad 20 contacts a topmost sheet (not shown) in the support tray pulling the same for alignment against reference edges 26 and 28. As the aligner is rotated in the direction shown by arrow 32, it is raised and lowered in the direction shown by double-headed arrow 34. By raising and lowering the aligner in the direction shown by double-headed arrow 34, when the aligner 18 enters the support tray, pad 20 will always be above the topmost sheet in the tray. Although a plurality of means can be used for raising and lowering the aligner so as to compensate for the variable height of a stack of sheets in the support tray, in one embodiment of this invention, a cam assembly 36 coacts with a splined assembly 38 to adjust the height of the aligner.

The cam assembly 36 includes a cam member 40 with a hole or opening fabricated through its center. The cam member is further characterized by a camming surface. The camming surface includes a working sector 42, a transitional sector 44 and a height adjustment sector 46. A cam follower 48 is fixedly coupled to shaft 22 and rides on the camming surface. In the preferred embodiment of the present invention, the cam follower 48 is in the shape of a pin. The cam member 40 is fixedly mounted or attached to the frame (not shown) of the assembly. The shaft 22 is rotatably mounted through the opening in the cam member 40. As the shaft is rotated and the cam follower 48 rides on the camming surface, when the cam follower is traversing working sector 42, the pad 20 is in contact with the topmost sheet in the paper support tray. As the cam follower traverses transitional sector 44, the pad disengages contact with the sheet, and when the cam follower 48 traverses height adjustment sector 46, the elongated arm 18 and the attached pad 20 are positioned at a height above the topmost sheet in the tray. Although the cam surface shown in FIG. 2 is of the notched type, it is within the skill of the art to use other types of cam surface such as an eliptical surface for generating the aforementioned motions without departing from the scope of the present invention.

Still referring to FIG. 2, splined assembly 38 generates a rotary motion for rotating shaft 22. The splined assembly also coacts with cam assembly 36 to generate a linear motion in a direction parallel to double-headed arrow 34. The splined assembly includes a splined sector 50 fabricated on one end of shaft 22. A splined pulley 52 coacts with the splined sector of shaft 22 to generate the linear motion. The splined pulley 52 is fabricated with a splined opening or hole running through its center. The spline-ended shaft is attached to the splined opening of the pulley. As the shaft is rotated and cam follower 48 begins to traverse transitional sector 44, the splined shaft is transported in a direction substantially parallel to double-headed arrow 34 to adjust the height of the pad. In order to rotate shaft 22, a belt 54 is wrapped around splined pulley 52. The belt is coupled to the drive shaft of a conventional drive means such as a motor (not shown). As the motor (not shown) is activated, the splined pulley 52 is rotated in the direction shown by arrow 56. This forces the aligner 18 to trace out a substantially circular path which brings the pad 20 cyclically into contact with a topmost sheet in the bin to align the same against the reference edges of said bin. Simultaneously as the cam following pin 48 traverses the transitional sector 44 and the height adjustment sector 46 of the cam surface, the spline-ended shaft is transposed in a linear direction parallel to arrow 34 thereby adjusting the height of the aligner relative to the variable height of a vertical stack of sheets in the bin. It is worthwhile noting that other types of height adjustment mechanisms may be used for adjusting the height of the aligner as it is transported in and out of the support tray without departing from the scope of the present invention. Also the shape and design of the aligner 18 should be construed as exemplary, since it is within the skill of the art to design other types of alignment shapes without departing from the scope of the present invention.

Figure 3:
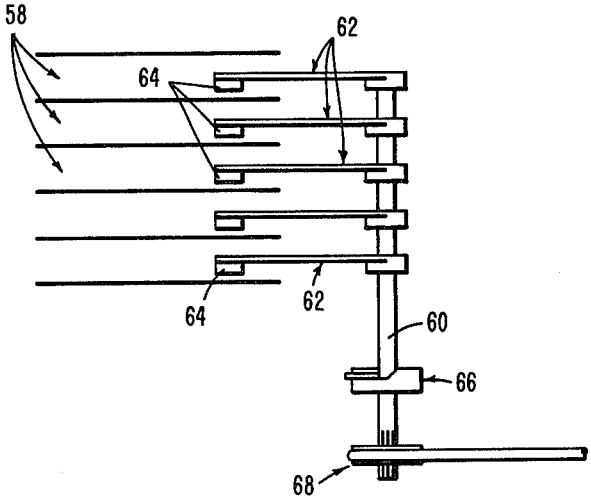
FIG. 3 shows multiple aligners mounted on a single shaft to align sheets in a plurality of sheet support trays.

FIG. 3 shows a sketch of an alternate embodiment according to the teachings of the present invention. In the sketch, a plurality of support bins are fixedly mounted to a support frame (not shown). The bins are arranged in stacked relation (that is, one on top of the other) with multiple spaces 58 separating the bins. A single shaft 60 is positioned relative to the bins. A plurality of alignment members 62 are fixedly coupled to the shaft. The free end of each of the alignment members is fitted with an alignment pad 64. The alignment arms are arranged in spaced relation along the length of the shaft. Also, each shaft is positioned relative to one of the pluralities of the support trays. The relationship is such that as sheets are hurled into each of the trays, the alignment shaft is rotated and linearly transposed so that each of the alignment pads enter its respective paper support tray at a predetermined height above the topmost sheet in that tray, descends to a level wherein the pad contacts the topmost sheet aligning the same against the referenced edges of each tray. The height adjustment member may be cam assembly 66. The cam assembly may be of a type such as that previously described in accordance with FIG. 2. Also the rotary and linear motion of shaft 60 can be generated by transport means 68. The transport means 68 may be of a splined assembly type similar to that described in accordance with FIG. 2.

Figure 4:
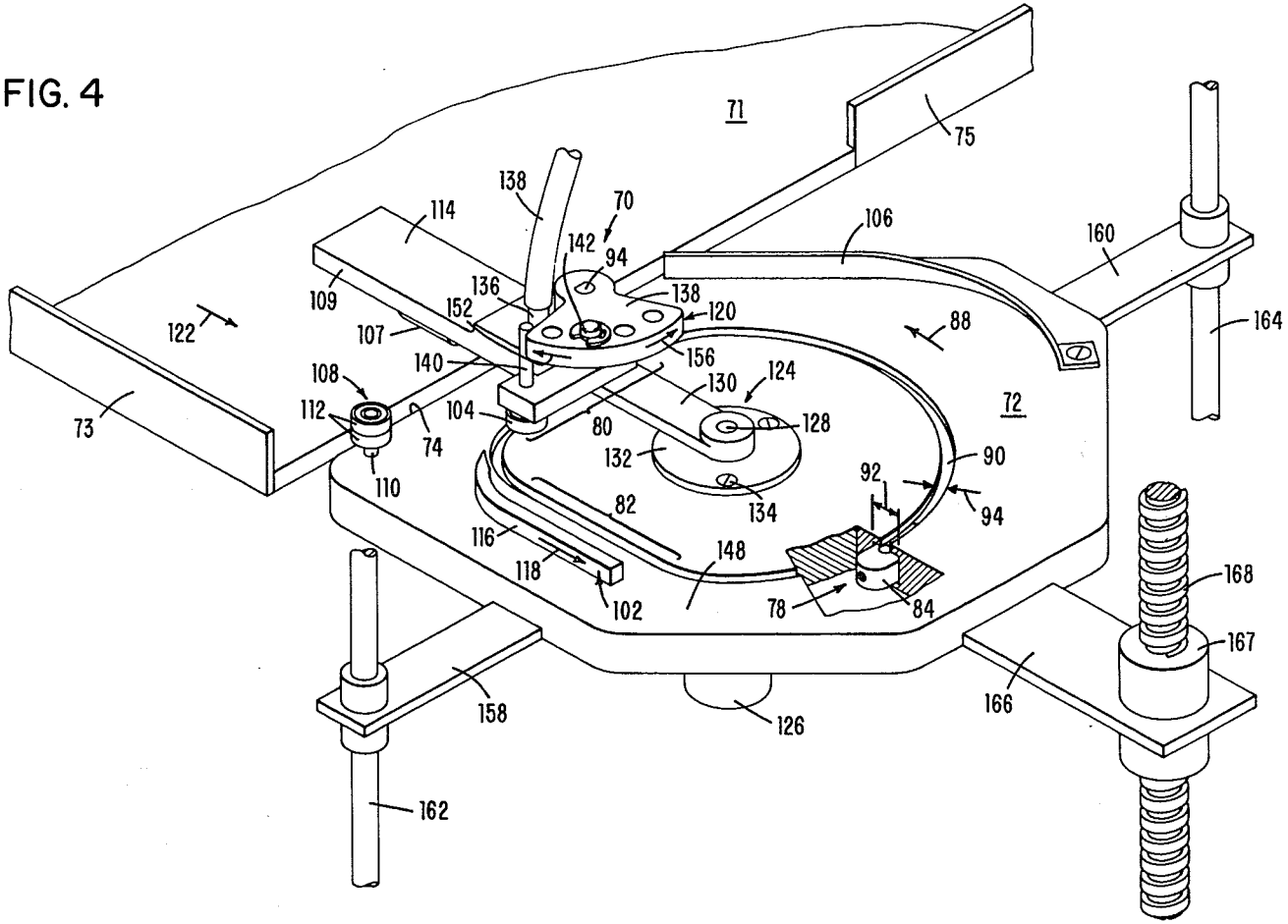
FIG. 4 shows an isometric view of the aligner mounted on a movable platform.

Referring now to FIG. 4, an isometric view of another embodiment of the present invention is shown. In this embodiment a paper aligner 70 is coupled to a platform 72. As will be described hereinafter, the platform may be fixed or movable. The platform is of a polygonal geometric configuration, and includes a grooved camming assembly which transposes aligner 70 into and out of a sheet support tray 71 wherein sheets in the tray are aligned against reference edges (73, 75) in a manner similar to that previously described. The platform is further fitted with height adjustment means which adjusts the height of the aligner in a plane perpendicular to the plane of the paper as the aligner enters in and out of the support tray. In the first instance it will be assumed that the platform 72 is fixedly mounted on a support frame (not shown), and the aligner 70 is projected for aligning paper in the single tray. The shape of platform 70 may be any desired configuration, however, in the preferred embodiment of the present invention, the platform has a polygonal shape with a relatively flat surface or edge 74 facing the support tray in which paper is to be aligned. The aligner assembly 70 and its supporting platform 72 is preferably of modular construction. As such, the aligner 70 can be removed from the platform assembly 72. An isometric view of the aligner assembly 70 is shown separately in FIG. 5. The details of the aligner will be described subsequently.

Figure 5:
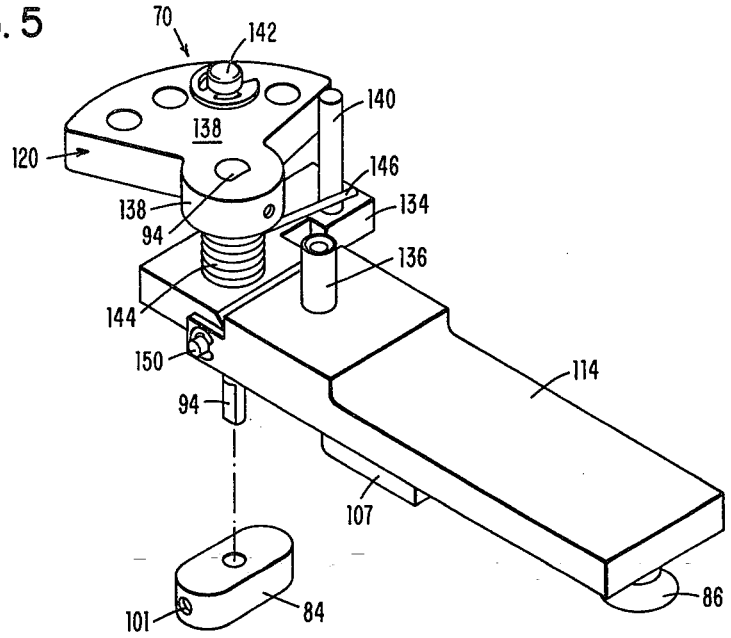
FIG. 5 shows an isometric view of the paper aligner.
Figure 7:
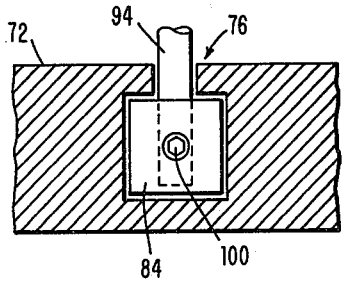
FIG. 7 shows a cross-section of a cam surface and cam follower. The cam surface and cam follower generates a trajectory which enables the aligner in FIG. 4 to trace out an alignment path.

Referring now to FIGS. 4, 5 and 7 respectively, a cam assembly 76 transports the aligner 70 so that it is cyclically brought into contact with the uppermost sheet in the paper tray 71. The cam assembly includes a grooved cam assembly 78 which is fabricated in the top surface of platform 72. The groove cam surface 78 is characterized by two substantially linear runs or sectors 80 and 82, respectively. As will be explained subsequently, when the cam follower 84 is traversing the substantially linear run of sectors 80 and 82, respectively, the tip of alignment member 86 (FIG. 5) is in contact with a sheet in the support tray. By way of example, if the aligning assembly 70 is transported or rotated in a direction shown by arrow 88, then as the aligner traverses sector 80, it is pulling an attached sheet in a first direction against reference edge 73 in the support bin. Similarly, when aligner 70 is traversing sector 82, it is pulling the sheet for alignment in the other substantially perpendicular direction for alignment against reference edge 75. While traversing sector 82, the alignment arm is also egressing from the support tray. As is evident from FIGS. 4 and 7, the cam surface on which cam follower 84 rides is grooved, that is, it is below the top surface of platform 72. The geometric configuration of the buried cam surface (not shown) is substantially equivalent to the cam slot 90 which can be seen running on the top surface of platform 72. The depth of the cam slot is approximately 0.400 inches, extending from the top surface of platform 72 into the material. The width 92 of the cam surface is recessed into the material on either side of cam slot opening 90.

As such, the width of the bottom 92 of the cam slot is wider than the width of the top 94 of cam slot 90. The cam follower 84, which is preferably an arcuate lug or member, is fitted into the cam surface from the back side of the support platform. Once the lug is fitted, it is trapped into said slot and cannot be removed through the cam slot 90.

Turning to FIG. 5 for the moment, the arcuately shaped cam follower 84 is fabricated with a central opening on the top surface, and a shaft 94 is fitted into the opening. The shaft is fabricated with a flat surface on the lower end which is inserted into the opening in the lug. A set screw 100 (FIG. 7) is threaded through hole 101 of the cam follower 84 to secure the shaft into the cam follower.

Returning now to FIG. 4, a curved guide member 102 is integrally mounted on the top surface of the support platform. As will be explained subsequently, the curved guide member is mounted on the platform so that the curved surface of the member coacts with a ball bearing member 104 to change the direction of travel of aligner assembly 70. A ramp assembly 106 is mounted in the path of travel of aligner assembly 70. The function of ramp assembly 106 is to adjust the height of the aligner assembly 70 so that it enters the support tray at a height higher than the topmost sheet in said tray. Of course, other height adjustment means can be used for adjusting the height of the aligner assembly 70 without departing from the scope of the present invention. A ramp follower 107 which is fitted to the underside of aligner arm 114, rides on the top surface of ramp assembly 106 and curved guide member 102 as the aligning assembly 70 is transported through its trajectory or path of travel.

Still referring to FIG. 4, a limiting means 108 is fixedly mounted to the top surface of the support platform. The function of the limiting means 108 is to control the range of travel of the alignment assembly 70. In the preferred embodiment of the present invention, limiting means 108 includes a shaft 110 which is fixedly mounted to the platform. The upper surface of the shaft is connected to a ball bearing 112. As the aligner assembler 70 is transported in its trajectory in a general direction shown by arrow 88, the leading edge or surface 109 of alignment arm 114 contacts the ball bearing 112. Simultaneously, ball bearing 104 rides on the outside surface 116 of the curved guide member 102 in a direction shown by arrow 118. By applying a positive tension to the alignment arm 114 by tensioning means 120, the arm is pulled in a direction shown by arrow 122, and a sheet with which it is in contact is aligned in the second direction against reference edge 75. Of course, during this second phase of the alignment routine, the cam follower 84 is traversing sector 82 of the cam surface.

Still referring to FIG. 4, the alignment assembly 70 is driven in its path by driving means 124. The driving means includes a motor 126 which is coupled through a drive shaft 128 to an elongated drive arm 130. The motor 126 is attached to a mounting disc 132. A central opening (not shown) is fabricated in the center of the support platform. The mounting disc 132 is fitted over the opening on the top side of the mounting platform. A plurality of screws such as screws 134, mount the mounting disc securely to the support platform. The motor 126 is then suspended from the mounting disc below the under side of the mounting platform. The end of the drive arm 130 is fitted with a notch (not shown). The notch contacts shaft 94 and drives the alignment assembly about its trajectory.

Referring now to FIG. 5, an isometric view of the alignment assembly is shown. In order to simplify the description, elements which are common to the alignment assembly in FIG. 5 and FIG. 4 are identified by the same numeral. The alignment assembly includes an elongated alignment arm 114 which is pivotally mounted to support base 134. A suction means 86 is mounted to the free end of the alignment arm 114. A vacuum passage (not shown) interconnects the suction cup 86 to a vacuum port 136. A flexible hose 138 (FIG. 4) interconnects the vacuum port 136 to a vacuum supply means (not shown). When vacuum is activated and the suction cup is positioned in contact with a sheet, friction is created between the cup and the sheet and as the arm moves, the sheet is pulled into alignment within the supply bin. Of course, it is within the skill of the present invention to use a high coefficient of friction pad to replace the suction cup and its attachment 86. By pivotally mounting the alignment arm to the support base, as ramp following means 107 rides on the top surface of ramp means 106, the alignment arm is adjusted in a plane perpendicular to the page and the arm enters the support tray at a height above the topmost sheet in the tray. As such, as the height of a stack varies in the tray, the arm adjusts so as to contact and align the topmost sheet in the stack.

Still referring to FIGS. 4 and 5, the tensioning means 120 includes a sectored tensioning disc 138. The sectored tensioning disc has a mounting hole through its center with a plurality of tensioning holes about the periphery of the sectored disc.

The upper end of shaft 94 is fixedly connected to the tensioning disc. Of course, the lower end of the shaft is connected to the cam follower 84. A tensioning pin 140 is fixedly mounted through support base 134 and in spaced relation to shaft 94. The upper end of fixed tension pin 140 extends above the surface of support base 134. Measured from shaft 94 (that is, the center of the sectored tensioning disc), the upper portion of the fixed support pin is approximately on the same radius as the plurality of tensioning holes positioned at the periphery of sectored tensioning disc 138. The function of the fixed tension pin 140 limits the rotation of the sectored tensioning disc 138 in a clockwise direction. Ball bearing 104 (FIG. 4) is fixedly coupled to the end of fixed tension pin 140 which extends below the surface of support base 134. A movable tension pin 142 sequentially mates with one of the peripheral tensioning holes. By changing the hole, the tension which is applied to the alignment arm 114 can be adjusted. A tensioning element 144 is coupled between the lower surface of the hub of the sectored tensioning disc 138 and the top surface of support base 134. In the preferred embodiment of this invention, the tensioning element 144 is an elongated length of wire. The strength of the wire determines the tensioning force. The wire is coiled around shaft 94 between the top surface of support base 134 and the lower surface of the hub. One end 146 of the tensioning wire is positioned for tensioning against the fixed tensioning rod 140. Similarly, the other end of the wire (not shown) is positioned against the descending portion of movable tensioning pin 142.

In operation, assume that the alignment arm is positioned at point 148 relative to the support platform. By activating drive motor 126, a rotary motion is imparted to shaft 128. The elongated drive arm 130 contacts shaft 94 pushing the same and its attachment alignment assembly 70 through a trajectory generated by cam assembly 78 (FIG. 4). Assume also that motion is counterclockwise in the direction shown by arrow 88. As elongated arm 114 approaches ramp 106, the ramp follower 107 which is mounted on the underside of alignment arm 114, rides on the top surface of the ramp. As the vertical height (measured from the top surface of support platform 72 upwardly) of the ramp increases the alignment arm 114 pivots in a vertical plane about pivot point 150 (FIG. 5). As such, the arm adjusts itself to touch a topmost sheet positioned within the support tray. As the arm exits from the high end of ramp 106, it falls into the support tray. During this time, cam follower 84 is traversing sector 80 of the cam surface. This is a linear sector and as such, the suction cup 86 is pulling the topmost sheet along a linear path, thereby aligning the same with a first reference edge 73 in the support tray.

During this time, the tensioning disc 130 is biased in a clockwise direction shown by arrow 152. The fixed tensioning pin 140 prevents the tensioning disc from rotating in the clockwise direction. As the cam follower 84 traverses a transitional zone, the leading edge 109 of the alignment arm is brought into contact with ball bearing 112. Simultaneously, ball bearing 104 is forced to travel in a curved trajectory on the outer surface 116 of curved guide member 102. The restrained motion now forces alignment arm 114 to change its direction of travel and moves in a direction parallel to arrow 122. Friction is minimized by the rotary action of ball bearing 104 and 112, respectively. Simultaneously with a change in the direction of travel, the tensioning disc 120 begins to rotate on itself in a counterclockwise direction shown by arrow 156. The rotary motion occurs at the center of the disc about shaft 94. The rotary motion imparts a high tension force to alignment arm 114. As a result of this tension, a sheet which is attached to the suction cup 86 is pulled by the arm in the second direction of alignment. During the time when the suction cup 86 is in contact with a sheet, vacuum is activated. After aligning the sheet, the arm is removed from the tray to the home position 148. Of course, any other position may be selected as a home position without departing from the scope of the present invention.

Still referring to FIG. 4, a pair of mounting brackets 158 and 160, respectively, are connected to the support platform. If the aligner is intended to service, that is align sheets in a single tray, then the mounting brackets 158 and 160 are fixedly connected to a support frame (not shown). The arrangement is such that the alignment arm 114 can enter support tray 71 and align sheets against the reference edges 73 and 75, respectively. However, as will be explained subsequently in accordance with FIG. 6, if the alignment mechanism is intended to service a plurality of support trays, that is, aligning sheets sequentially in a plurality of alignment trays, an indexing mechanism is connected to the platform 72. The purpose of the indexing mechanism is to index the support platform so that the alignment arm is transported between the trays to align sheets therein. Although it is within the skill of the art to design a plurality of alignment mechanisms, in the preferred embodiment of the present invention the mounting brackets 158 and 160 are slidably coupled to guide rods 162 and 164, respectively. A third bracket 166 is fixedly mounted to the support platform 72. The bracket is then coupled through a suitable coupling means 167 to a lead screw 168. A drive motor 170 (FIG. 6) is coupled to the lead screw. When the motor is controllably energized, the support platform is indexed to a predetermined amount, thereby bringing alignment mechanism into the correct position to act on a chosen support tray.

Figure 6:
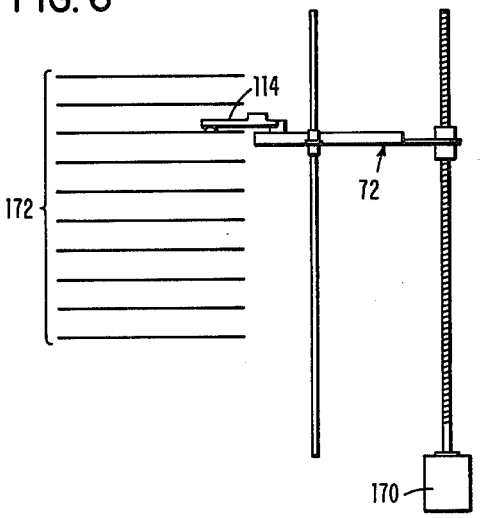
FIG. 6 shows a schematic of the aligner and movable platform positioned relative to a plurality of sheet support trays.

As is shown in FIG. 6, a single platform 72 is indexed so that alignment arm 114 is transported to align sheets in one of the pluralities of bins or support trays mounted in module 172. As the platform 72 is indexed between the support trays so that the alignment arm 114 extends into a selected support tray, the aforementioned alignment procedure is performed in each tray, thereby forming aligned pile of sheets within each tray.

By using the above invention, the need to adjust the aligner mechanism to compensate for various paper sizes is eliminated.

While the invention has been described primarily in terms of aligning sheets outputted from an electrophotographic copier, the teaching and principle is applicable to any environment where sheet-like materials are to be aligned. Therefore, other modifications and changes may be made by a person of ordinary skill without departing from the spirit and scope of the present invention.

What is claimed is:

1. An apparatus for receiving sheets in seriatim, stacking the sheets into a vertical stack and aligning said sheets during formation of the stack, said apparatus comprising:

a stack support tray having at least one reference edge thereon and at least one entrance for receiving incoming sheets;

a paper aligner positioned relative to the support tray and operable to contact an incoming sheet pulling the sheet in at least one direction substantially perpendicular to the reference edge;

a cam having a central opening with a camming surface positioned relative to the opening, said surface having a configuration for imparting a predetermined trajectory to the paper aligner;

a shaft coupled to the paper aligner and rotatably mounted in the central opening, said shaft having a cam follower fixedly mounted thereto, said cam follower being operable to ride on said camming surface; and means for rotating the shaft.

2. The apparatus of claim 1 wherein the camming surface is further characterized by a run operable to adjust the height of the paper aligner in a direction perpendicular to the plane of rotation.

3. The apparatus of claim 1 wherein the paper aligner is an elongated member having one end fixedly attached to the shaft and the other end extending into the stack support tray and operable to contact and to align sheets in said tray.

4. The apparatus of claim 3 further including a high coefficient of friction pad coupled to the end of the paper aligner extending into the stack support tray.

5. The apparatus of claim 4 wherein the high coefficient of friction pad is a urethane pad.

6. The apparatus of claim 3 further including means for supplying a vacuum to the paper aligner.

7. A device for aligning and stacking sheets delivered from an electrophotographic device said device comprising:

a sheet receiving bin having two adjacent reference edges;

a sheet aligner operable to cyclically contact sheets entering the bin and pulling said sheets along two substantially mutually perpendicular directions against the reference edges;

a rotating shaft coupled to said sheet aligner and operable to position said sheet aligner to contact said sheets;

a cam having a central opening to receive one end of said shaft, said cam having a cam following surface positioned relative to the central opening;

a cam follower fixedly coupled to the shaft and operable for riding on the cam surface; and means coupled to the shaft and operable for driving the shaft.

8. The apparatus of claim 7 further including means associated with the shaft and operable to adjust the height of the sheet aligner so that as a stack of sheets is being formed in the sheet receiving bin, the aligner is positioned to contact the topmost sheet.

9. A single-ended rotary bidirectional sheet aligner apparatus for aligning sheets entering a bin one at a time from a first or a second direction against first and second reference edges affixed to adjacent sides of said bin, said first reference edge facing said first direction and said second reference edge facing said second direction, said apparatus comprising:

a cam positioned relative to said bin, including a central opening and a camming surface on the top thereof;

a shaft rotatably coupled to the central opening of said cam, said shaft including a cam follower for tracking said camming surface as said shaft is rotated;

an aligning arm fixedly coupled to said shaft;

a pad fixedly coupled to said aligning arm; and means for rotating said shaft in synchronization with said sheets entering said bin such that as said cam follower of said shaft tracks said camming surface of said cam, said arm enters said bin above the height of a topmost sheet entering said bin, and said pad of said arm makes contact with said sheet in said bin, thereby moving said sheet up against said reference edges of said bin as said shaft is rotated out of said bin.

10. A two-position rotary paper aligner device suitable for aligning copy sheets outputted from a convenience copier comprising in combination:

a copy sheet support tray having at least one aligning surface thereon and operable to receive sheets outputted from the copier;

a cylindrical cam positioned relative to said tray and having a central opening therethrough with a camming surface fabricated thereon;

a shaft rotatably coupled to the central opening, said shaft having a splined section and positioned relative to the support tray;

a sheet aligning arm coupled to the shaft and operable to contact a topmost sheet in the tray and to align said sheet against the aligning surface;

a cam follower fixedly coupled to the shaft and operable to ride on the camming surface; and a splined pulley operably coupled to the splined section of the shaft so that as the cam follower rides on a predetermined sector of the camming surface, the shaft is transported linearly to adjust the height of the aligning arm relative to the sheets in the tray.

11. The two-position rotary paper aligner device recited in claim 10 further including means coupled to the pulley and operable to rotate said pulley.

12. The device as is claimed in claim 11 further including:

a plurality of copy sheet support trays, said copy sheet support trays arranged in a stacked but spaced relation; and a plurality of aligning arms, coupled to the shaft, said arms being operable to enter an associated support tray and to align copy sheets therein.

13. A two-directional aligner comprising:

a support means having at least one registration surface thereon and operable to receive sheet-like material;

a platform means mounted relative to the support means, said platform means having a cam surface thereon for imparting a predetermined trajectory;

a cam follower means operably associated with the cam surface;

an alignment arm coupled to the cam follower means, said alignment arm being operable to trace out a predetermined trajectory including a sector wherein sheet-like material in the support means is being aligned against the registration surface;

means positioned relative to the alignment arm and operable to adjust the height at which the alignment arm contacts the sheet-like material; and means for transporting the cam follower means about the cam surface.

14. The apparatus of claim 13 further including means associated with the platform means and operable to limit the range of travel of the alignment arm;

means positioned relative to the cam surface and operable to guide said cam follower so that the alignment arm changes direction of travel; and means for biasing the alignment arm.

15. The aligner recited in claim 14 wherein the support means include a plurality of trays arranged in a stacked but spaced relation.

16. The aligner of claim 15 further including a means for indexing the platform means so that the aligner is transported between the trays to align sheets therein.

* * * * *